US011613949B2

(12) United States Patent
Tinnen

(10) Patent No.: US 11,613,949 B2
(45) Date of Patent: Mar. 28, 2023

(54) APPARATUS FOR PERFORMING MULTIPLE DOWNHOLE OPERATIONS IN A PRODUCTION TUBING TUBULAR

(71) Applicant: Altus Intervention (Technologies) AS, Stavanger (NO)

(72) Inventor: Bard Martin Tinnen, Stavanger (NO)

(73) Assignee: Altus Intervention (Technologies) AS, Stavanger (NO)

( * ) Notice: Subject to any disclaimer, the term of this patent is extended or adjusted under 35 U.S.C. 154(b) by 0 days.

(21) Appl. No.: 17/941,766

(22) Filed: Sep. 9, 2022

(65) Prior Publication Data

US 2023/0055063 A1 Feb. 23, 2023

Related U.S. Application Data

(63) Continuation of application No. 16/761,874, filed as application No. PCT/NO2018/050279 on Nov. 15, 2018, now Pat. No. 11,459,841.

(30) Foreign Application Priority Data

Nov. 20, 2017 (NO) ..... 20171843

(51) Int. Cl.

| | |
|---|---|
| ***E21B 23/06*** | (2006.01) |
| ***E21B 29/00*** | (2006.01) |
| ***E21B 33/12*** | (2006.01) |
| ***E21B 33/13*** | (2006.01) |

(52) U.S. Cl.

CPC ..... *E21B 23/06* (2013.01); *E21B 29/00* (2013.01); *E21B 33/12* (2013.01); *E21B 33/13* (2013.01)

(58) Field of Classification Search

None

See application file for complete search history.

(56) References Cited

U.S. PATENT DOCUMENTS

| | | | | |
|---|---|---|---|---|
| 1,874,880 | A * | 8/1932 | Brotherton | E21B 29/005 166/55.8 |
| 2,993,539 | A * | 7/1961 | Baker | E21B 37/00 166/99 |
| 5,669,448 | A * | 9/1997 | Minthorn | E21B 43/116 166/308.1 |
| 6,341,653 | B1 * | 1/2002 | Firmaniuk | E21B 27/00 166/99 |
| 6,629,565 | B2 * | 10/2003 | Harrell | E21B 23/00 166/55.7 |
| 7,017,672 | B2 * | 3/2006 | Owen, Sr. | E21B 23/06 166/123 |
| 8,955,597 | B2 * | 2/2015 | Connell | E21B 29/005 166/290 |
| 9,334,712 | B2 * | 5/2016 | Bakken | E21B 37/00 |
| 9,488,024 | B2 * | 11/2016 | Hoffman | E21B 33/13 |

(Continued)

FOREIGN PATENT DOCUMENTS

| | | |
|---|---|---|
| EP | 3085882 A1 | 10/2016 |
| WO | 2014175750 A1 | 10/2014 |

*Primary Examiner* — Steven A MacDonald

(74) *Attorney, Agent, or Firm* — GableGotwals

(57) ABSTRACT

A downhole apparatus including a sleeve, a tool string, a plug, a means for setting the plug wherein an upper portion of the sleeve is connectable to a lower portion of the tool string, and a lower portion of the sleeve is arranged to receive the plug and the means for setting the plug. A method for using the downhole apparatus (1) is disclosed.

10 Claims, 4 Drawing Sheets

(56) References Cited

U.S. PATENT DOCUMENTS 9,677,362 B2 * 6/2017 Surjaatmadja ..... E21B 47/12
9,810,035 B1 * 11/2017 Carr ..... E21B 23/065
9,816,342 B2 11/2017 Pedersen et al.
9,951,579 B2 * 4/2018 Jones ..... E21B 33/134
10,151,164 B2 * 12/2018 Bennett ..... E21B 29/005
10,246,974 B2 * 4/2019 Greenway ..... E21B 43/117
10,487,605 B2 * 11/2019 Nelson ..... E21B 33/12
10,724,328 B2 7/2020 Kruger
2005/0263282 A1 12/2005 Jeffrey et al.
2008/0314591 A1 * 12/2008 Hales ..... E21B 33/124 166/285
2014/0124199 A1 5/2014 Gorrara et al.
2014/0251616 A1 9/2014 O'Rourke et al.
2015/0233218 A1 * 8/2015 Myhre ..... E21B 43/114 166/281
2015/0275605 A1 * 10/2015 Bennett ..... E21B 33/134 166/55.1
2016/0040495 A1 * 2/2016 Mahajan ..... E21B 10/60 166/99
2016/0040496 A1 * 2/2016 Mahajan ..... E21B 10/60 166/99
2016/0060989 A1 3/2016 Pedersen et al.
2016/0130901 A1 * 5/2016 Coronado ..... E21B 29/005 166/298
2016/0305215 A1 10/2016 Harris et al.
2017/0016305 A1 * 1/2017 Prieur ..... E21B 28/00
2017/0089166 A1 3/2017 Sullivan
2017/0159388 A1 * 6/2017 Volgmann ..... E21B 17/07
2018/0066489 A1 * 3/2018 Pipchuk ..... E21B 33/1208
2018/0100373 A1 4/2018 Kruger
2018/0216432 A1 * 8/2018 Nelson ..... E21B 29/002
2019/0226327 A1 * 7/2019 Telfer ..... E21B 23/00
2019/0249549 A1 * 8/2019 Fripp ..... E21B 47/18
2020/0072009 A1 * 3/2020 Fairweather ..... E21B 29/005
2020/0131874 A1 * 4/2020 Cajiles ..... E21B 27/00
2020/0173249 A1 * 6/2020 Fairweather ..... E21B 33/13
2022/0195824 A1 * 6/2022 Scharf ..... E21B 29/002
2022/0333454 A1 * 10/2022 Fairweather ..... E21B 29/002

* cited by examiner

APPARATUS FOR PERFORMING MULTIPLE DOWNHOLE OPERATIONS IN A PRODUCTION TUBING TUBULAR

CROSS-REFERENCE TO RELATED APPLICATIONS

This current application is a continuation application of U.S. patent application Ser. No. 16/761,874 filed May 6, 2020 which claims priority to PCT Application NO2018/050279 filed Nov. 15, 2018 which claims priority to Norwegian Patent Application No. 20171843 filed Nov. 20, 2017, each of which are incorporated herein by reference.

BACKGROUND OF THE INVENTION

The invention relates to a downhole apparatus for performing multiple downhole operations in a well. More particularly, the invention relates to a downhole apparatus for plugging, punching and/or cutting a production tubular in a single run into the well. The downhole apparatus is configured for isolating a section of the well by setting a plug by means of a plug setting tool. The downhole apparatus is further configured for punching holes in the production tubular above the plug to enable circulation of a fluid from an inside of the production tubular to an annulus on an outside of the production tubular, or vice versa. The downhole apparatus is further configured for forming a cut in the production tubular above the plug for retrieval to a surface of the tubular section above the cut. A lower portion of the downhole apparatus comprises the plug and means for setting the plug. An upper portion of the downhole apparatus comprises a tool string. The lower portion and the upper portion of the downhole apparatus is mechanically coupled by a sleeve. The sleeve is configured to house a tubing puncher and/or a tubing cutter. The downhole apparatus is configured to be run into the well by a wireline. The invention also relates to a method for performing downhole operations in a well using the downhole apparatus.

A wireline or slickline is often used to lower a bottom hole assembly from a surface into a wellbore; to supply energy to the bottom hole assembly and to transmit data from the wellbore. Wireline operations may comprise plugging, reservoir measurements such as pressure, temperature and flow, leak detection, pipe cutting and punching. The operations may be performed to optimize production from the well or repair a faulty barrier in the well. The bottom hole assembly may comprise of several tools, for example running and pulling tools, fishing tools, explosive tools and logging tools.

When preparing a well for recompletion or permanent abandonment, there is an operational sequence involving steps of:

- setting a barrier plug at a location below a cutting point;
- punching the production tubular to enable circulation of a heavy fluid inside the production tubular and the surrounding annulus; and
- cutting the production tube.

Subsequently, the production tubular above the cut will be retrieved from the wellbore. The operational sequence is typically performed in several wireline runs into the wellbore. A first run is performed to install a barrier by means of a barrier plug. The tool string includes the barrier plug itself and necessary tooling to position and install the barrier plug at a correct location. The barrier plug commonly being a retrievable or permanent bridge plug. Then, a second run is performed to punch a hole in the production tubular to enable circulation of a heavy fluid into the production tubular and a surrounding annulus between the production tubular and a casing. The tool string includes a hole punching tool, typically an explosive device or a mechanical device or a device of another working principle. Finally, a third run is performed to cut the production tubular above the barrier plug. The tool string includes a tubing cutting tool, typically a mechanical device or an explosive device or a chemical device or a device of another working principles. In some instances, a fourth run is performed to install a junk basket in the production tubular.

Performing the above-mentioned operational sequence in three separate runs requires a relatively long operational time. It involves three separate exercises of lowering, operating and hoisting the wireline toolstring in and out of the wellbore. There are further two rigging sequences between the runs to change toolstring. The long operational time entails a high rig and equipment rental cost. The cost could be reduced if the number of runs into the well is reduced.

From the prior art, it is known to perform the barrier plug installation and tubing punching in a single run in the well using an integrated tool string consisting of a barrier plug, a plug setting tool and a tubing punching tool, ref. "Mechanical Puncher Tool" by Interwell Norway AS. Patent document EP3085882 discloses a method of plugging a well using cement and cutting the well tubular in a single run. The method presupposes that a barrier plug is in place to isolate the lower part of the well tubular prior to cementing.

SUMMARY OF THE INVENTION

It is an objective of the invention to provide an apparatus that is capable of at least reducing one run into the well during barrier installation, punching and cutting operations. It is also an objective of the invention to provide an apparatus that can perform all three operations in a single run into the wellbore. It is a further objective of the invention to provide an apparatus that can perform all three operations and install a junk basket in a single run into the wellbore.

The invention has for its object to remedy or to reduce at least one of the drawbacks of the prior art, or at least provide a useful alternative to prior art.

The object is achieved through features, which are specified in the description below and in the claims that follow.

The invention is defined by the independent patent claims. The dependent claims define advantageous embodiments of the invention.

In a first aspect, the invention relates more particularly a downhole apparatus, the downhole apparatus comprising:

- a tool string;
- a plug, and
- a means for setting the plug, wherein an upper portion of a sleeve is connectable to a lower portion of the tool string, and a lower portion of the sleeve is arranged to receive the plug and the means for setting the plug.

The first end of the sleeve may be an upper end and the second end of the sleeve may be a lower end when the apparatus is positioned in a well. The sleeve may be a hollow cylindrical. Other similar definitions of a sleeve may be a mandrel, a bushing, a casing or a tube.

The plug may for example be a retrievable or permanent bridge plug. The lower portion of the sleeve may be connected to the means for setting the plug, such that when releasing the sleeve from the tool string, the sleeve may stay in place with the plug and the means for setting the plug. The tool string may be displaced upwards within the production tubing by pulling after releasing the sleeve. The tool string may comprise auxiliary devices for operating the downhole apparatus, e.g. sensors, control devices, hydraulic actuators, electric motors etc. The upper portion of the sleeve may be connected to the lower portion of the tool string by means of a releasable connection, such as shear pins or screw mechanism.

In one embodiment, the sleeve, between its upper and lower portion, may be configured to house at least one tool. In one embodiment, the sleeve may house one tool. In another embodiment, the sleeve may house more than one tool. The at least one tool may be configured to perform downhole operations in the well. The at least one tool may be operated electrically or hydraulically. Electric current may for example be supplied via a wireline from surface, or from batteries in the tool string. Hydraulic power may be supplied from an actuator in the tool string.

In one embodiment, the sleeve, between its upper and lower portion, may be configured to house a first tool and a second tool. The first tool may be a tubing punching tool. The second tool may be a tubing cutting tool. The first tool and the second tool may be arranged in series along a longitudinal axis of the tool string. In one embodiment, the two tools may be connected to each other. In one embodiment, the first tool may be arranged closest to the tool string, and may be connected to the tool string. The two tools may be operated independently of each other. Means for controlling the second tool may be arranged from the tool string and through the first tool.

The sleeve may house at least a portion of the means for setting the plug. The means for setting the plug may be a plug setting tool. In one embodiment, the means for setting the plug may be an integral part of the plug. In one embodiment, the sleeve may house the entire means for setting the plug. The plug may be connected to the sleeve. The sleeve and plug may form an integral unit.

In one embodiment, the means for setting the plug may communicate with a control device via a communication means. The communication means may be a communication line, an activation line or wireless communication. At least a portion of the communication line or activation line may be integrated in a body of the sleeve. The control device may be arranged in the tool string. The communication line or activation line may for example be an electric line or a hydraulic line. In one embodiment, the portion of the communication line or activation line being integrated in the body of the sleeve may communicate with the not integrated part of the communication line or activation line via wireless means such as inductive couplers or pressure pulses. In one embodiment, the communication line or activation line may be free-running from the tool string to the plug setting tool. Free-running meaning not integrated in a body of the sleeve.

In one embodiment, the upper portion of the sleeve may be connectable to the tool string by a releasable latching mechanism. The latching mechanism may interact with an internal surface of the sleeve. The latching mechanism may have latching dogs. The latching dogs may be complementary to grooves in the sleeve. The latching mechanism may be operable between an engaged and an open position. In the open position, the tool string may move freely relative to the sleeve. In the engaged position, the sleeve and the tool string may be locked from moving relative to each other in an axial direction. The latching mechanism may be activated by an operator command, or automatically, for example by some predetermined hydraulic pressure value. In one embodiment, the sleeve may be connectable to the tool string by means of ball grabs.

In one embodiment, the sleeve may be configured as a junk basket when disconnected from the tool string. The junk basket may collect debris, such as; rust, metal swarf, scale, sand, silt etc. The debris may be retrieved together with the sleeve. In one embodiment, the sleeve may be releasable from the plug for retrieval of the sleeve to surface.

In one embodiment, the tool string may comprise a multifinger caliper. The multifinger caliper comprises a plurality of radially extendable rods, the rods also being defined as fingers. When extended, the fingers will measure changes in the internal diameter of a tubular when the multifinger caliper is moved up the tubular. By measuring the internal diameter of the tubular, the multifinger caliper may detect changes in the surface condition, e.g. corrosion or depositions. The multifinger caliper may be arranged on the tool string above the sleeve. Performing measurements using a multifinger caliper would normally require an additional run in the well if using traditional tools. Including a multifinger caliper on the tool string may enable another operation to be performed in the same run as the previously mentioned operations.

In one embodiment, the tool string may comprise a wireline tractor. The wireline tractor can move along the well for displacing the tool string and downhole apparatus. This may be a preferable embodiment in deviated or horizontal wells, where gravity alone is not sufficient to displace the downhole apparatus and tool string. In one embodiment, the wireline tractor may comprise grinding elements. The wireline tractor may further comprise wheels, wherein the grinding elements may be arranged on the wheels. The grinding elements may be configured to perform tubing punching. In one embodiment, the grinding elements may replace the tubing puncher for punching the tubular in the well.

In a second aspect, the invention relates more particularly to a method for a downhole operation using the downhole apparatus according to any of the preceding claims, wherein the method comprises the steps of:

a) running the downhole apparatus into the well, and b) setting the plug in the well tubular.

In one embodiment, the method, after step b), may further comprise the steps of:

c) releasing the sleeve from the tool string;

d) displacing the tool string relative to the sleeve, and e) perforating the well tubular above the sleeve.

The well tubular may be perforated by operating the tubing puncher. In one embodiment, the well tubular may be perforated by operating the grinding elements on the wireline tractor.

In one embodiment of the method, after step b), further comprises the steps of:

f) releasing the sleeve from the tool string;

g) displacing the tool string relative to the sleeve, and h) cutting the well tubular above the sleeve.

The well tubular may be cut by operating a tubing cutter.

In one embodiment, the method, after step b), further comprises the steps of:

i) releasing the sleeve from the tool string;

j) displacing the tool string relative to the sleeve;

k) perforating the well tubular above the sleeve, and l) cutting the well tubular above the sleeve.

BRIEF DESCRIPTION OF THE SEVERAL VIEWS OF THE DRAWINGS

In the following is described an example of a preferred embodiment illustrated in the accompanying drawings, wherein.

DETAILED DESCRIPTION OF THE INVENTION

Figure 1:
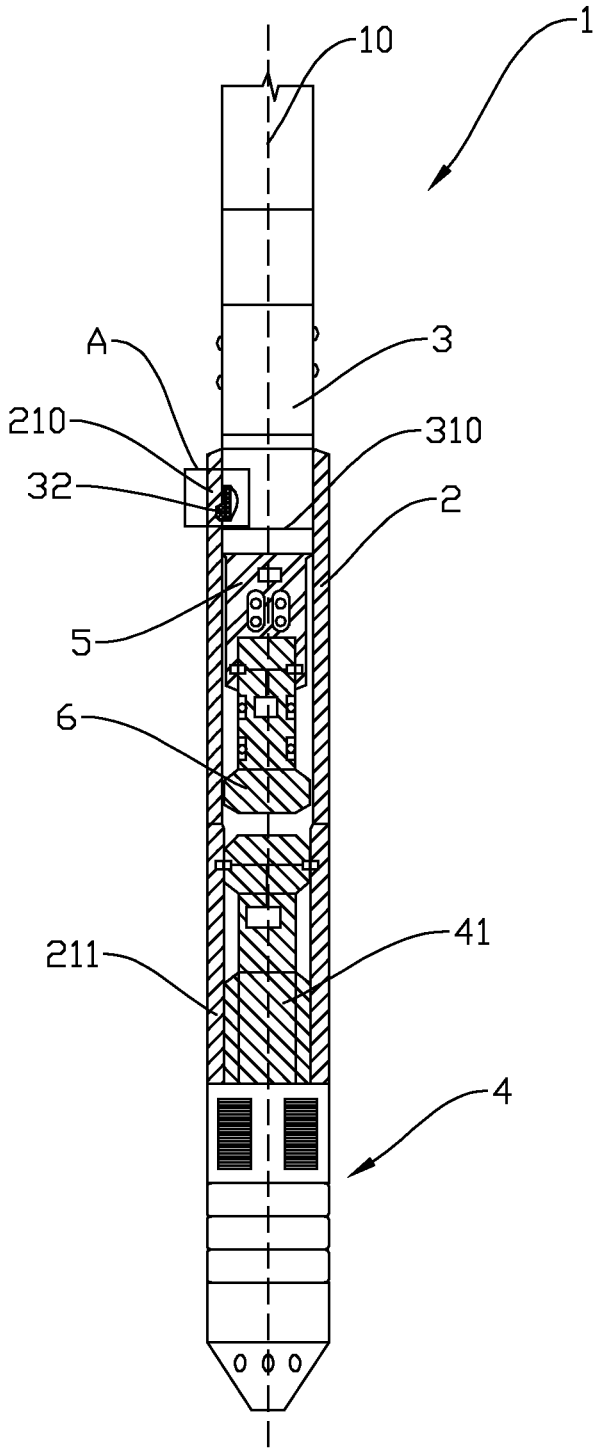
FIG. 1 shows a schematic elevation, partially in cross-section, of the downhole apparatus according to one embodiment of the invention.

The figures are depicted in a simplified manner, and details that are not relevant to illustrate what is new with the invention may have been excluded from the figures. The different elements in the figures may necessarily not be shown in the correct scale in relation to each other. Equal reference numbers refer to equal or similar elements. In what follows, the reference numeral 1 indicates a downhole apparatus according to the invention.

The downhole apparatus 1 comprises a sleeve 2. An upper portion 210 of the sleeve 2 is releasably connected to a lower portion 310 of a tool string 3 by means of a latching mechanism 32. A lower portion 211 of the sleeve 2 is connected to a plug 4 and a plug setting tool 41. The sleeve 2 is shown housing a tubing punching tool 5 and a tubing cutting tool 6.

Figure 3A:
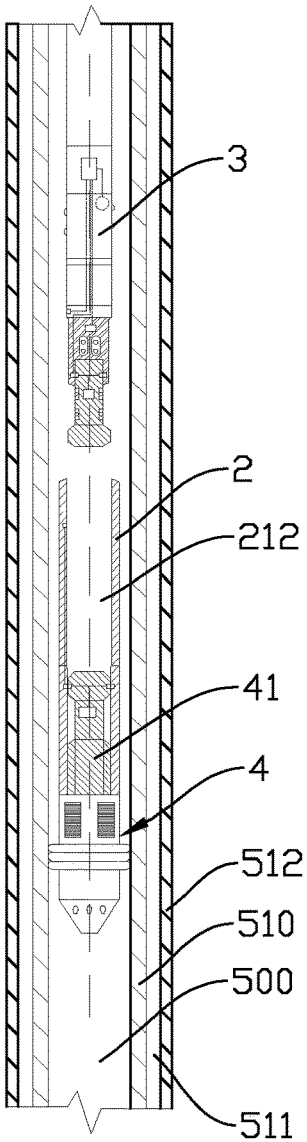
FIG. 3*a* shows the downhole apparatus in FIG. 1 in a smaller scale, wherein the plug is set and the tool string disconnected from the sleeve.

FIG. 1 shows the plug 4, in this particular embodiment shown as a temporary barrier plug, connected to the lower portion 211 of the sleeve 2 via the plug setting tool 41. The plug 4 may be installed at a desired location in a production tubular 510 (see FIGS. 3*a*-3*c*) by means of the plug setting tool 41. The plug setting tool 41 is housed within the sleeve 2. In another embodiment, the plug setting tool 41 may be an integral part of the plug 4. When the plug 4 is set in the production tubular 510, the sleeve 2 may be released from the tool string 3, and the sleeve 2 may be left in place together with the plug 4 and the plug setting tool 41 (see FIGS. 3*a*-3*c*).

FIG. 1 further shows the sleeve 2 housing a tubing punching tool 5, in the following called a puncher. The puncher 5 is connected to the lower portion 310 of the tool string 3. The puncher 5 is configured to punch, i.e. perforate, a production tubular 510 in the well 500 (see FIG. 3*a*-3*c*) to allow for circulation of a fluid 600 from the well 500 to an annulus 511 between the production tubular 510 and a casing 512 (see FIG. 3*a*-3*c*). The puncher 5 may be an explosive device or a mechanical device or a device of another working principle. After setting the plug 4 and disconnecting the sleeve 2 from the tool string 3, the puncher 5 is pulled out of the sleeve 2. Thus, punching can be performed on the production tubular 510 above the sleeve 2.

A tubing cutting tool 6, in the following called cutter, is connected to the puncher 5. The cutter 6 is configured to cut the production tubular 510 at a desired location above the sleeve 2. After cutting, the tubular 510 above the cut 530 may be retrieved to surface. The cutter 6 may be a mechanical device or an explosive device or a chemical device or a device of another working principle. To avoid risk of the cutter 6 getting stuck due to tubing displacement, for example scissoring, after cutting, it is an advantage to have the cutter 6 at the lower end of the tool string 3, however, this is not a requirement.

Figure 2A:
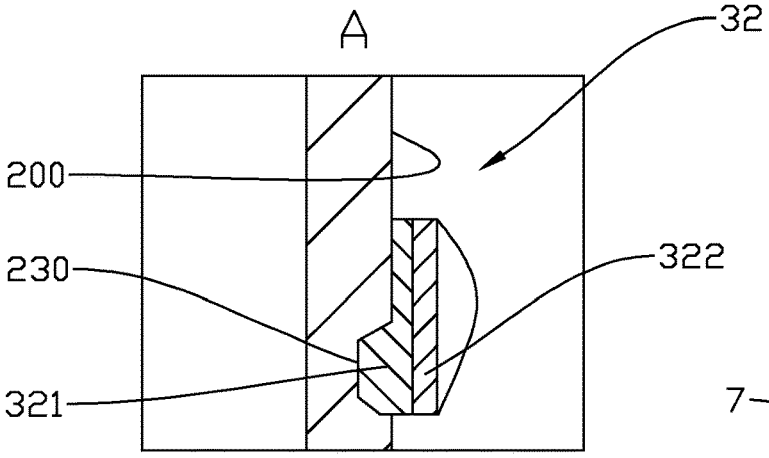
FIG. 2*a* shows in a larger scale the detail A of the latching mechanism in FIG. 1.

FIG. 2*a* shows a detail of the latching mechanism 32. The latching mechanism 32 has a plurality of latching dogs 321 arranged around a circumference (not shown) of the tool string 3. The latching dogs 321 are moveable between an engaged position and an open position by means of a latching mandrel 322. The latching dogs 321 are complementary to grooves 230 in the internal surface 200 of the sleeve 2. The groove 230 may be a circular, circumferential groove (not shown). To engage the latching mechanism 32, the latching dogs 321 are moved radially out from a longitudinal centre axis 10 of the downhole apparatus 1. When the latching dogs 321 are engaged in the grooves 210, the sleeve 2 will move with the tool string 3. When the latching dogs 321 are open, the tool string 3 is free to move independently of the sleeve 2 in an axial direction.

Figure 2B:
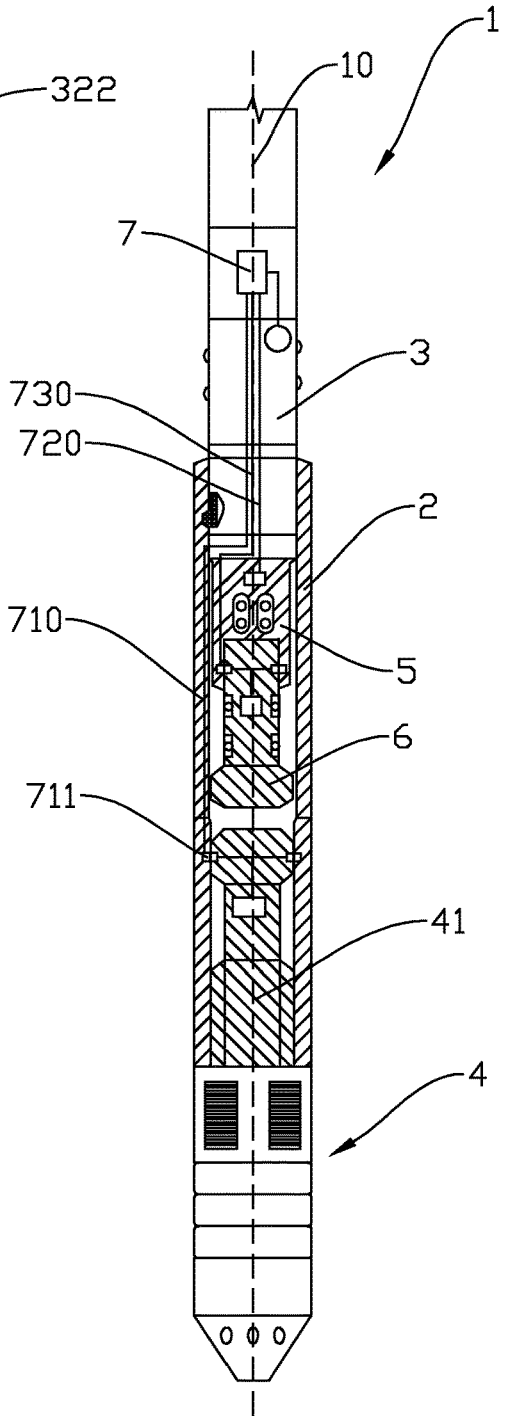
FIG. 2*b* shows the downhole apparatus in FIG. 1, comprising a control system.

FIG. 2*b* shows the downhole apparatus 1 comprising a control device 7 arranged in the tool string 3. The control device 7 may operate the plug setting tool 41. The control device 7 and plug setting tool 41 are connected with a communication line 710. A portion of the communication line 710 is integrated in the body of the sleeve 2. The communication line 710 is shown with inductive couplers 711 for transferring a signal wirelessly from the sleeve 2 to the plug setting tool 41. Several inductive couplers 711 may be arranged around a circumference (not shown) of the plug setting tool 41. The control device 7 may also be used to operate the puncher 5 and/or cutter 6 via communication lines 720, 730. The communication line 730 running between the control device 7 and cutter 6 is shown routed through the puncher 5. It should be understood that other means for communication may be used to operate the plug setting tool 41 and/or puncher 5 and/or cutter 6, for example hydraulic lines.

In use, the downhole apparatus 1 will be lowered into the well 500. The plug 4 is set to isolate a section of the well 500 above the plug 4, see FIG. 3*a*. The procedure for setting the plug 4 will not be explained in further detail as this is considered standard procedure for a person skilled in the art. The latching mechanism 32 is disengaged and the tool string 3 pulled back/up the well. The sleeve 2 will stay in place together with the plug 4 and the plug setting tool 41. In one embodiment, the sleeve 2 may be configured as a junk basket to gather debris from the well 500 when disconnected from the tool string 3.

Figure 3B:
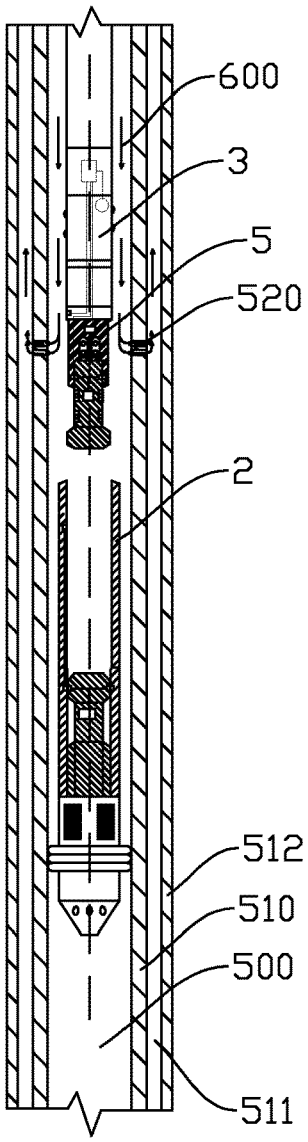
FIG. 3*b* shows the same downhole apparatus as in FIG. 3*a*, wherein holes have been punched in the well tubular.
Figure 3C:
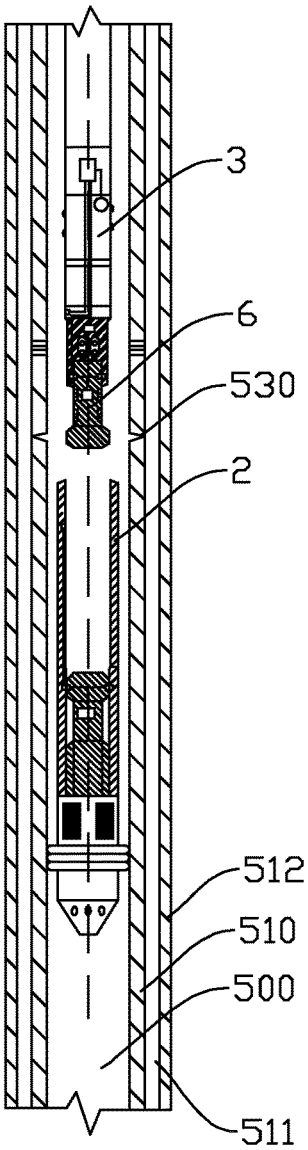
FIG. 3*c* shows the same downhole apparatus as in FIG. 3*b*, wherein the well tubular has been cut.

At an elevation above the sleeve 2, the puncher 5 can be operated to punch one or more holes 520 in the well tubular 510, see FIG. 3*b*. Punching can be performed by any working principle. The holes 520 will allow for circulation of the fluid 600 from the well 500 and into the annulus 511 between the production tubular 510 and the casing 512. The cutter 6 can be operated to form a cut 530 in the tubular 510, see FIG. 3*c*. Cutting can be performed by any working principle. In one embodiment, the tubular 510 above the cut 530 can be retrieved to surface (not shown).

Figure 4A:
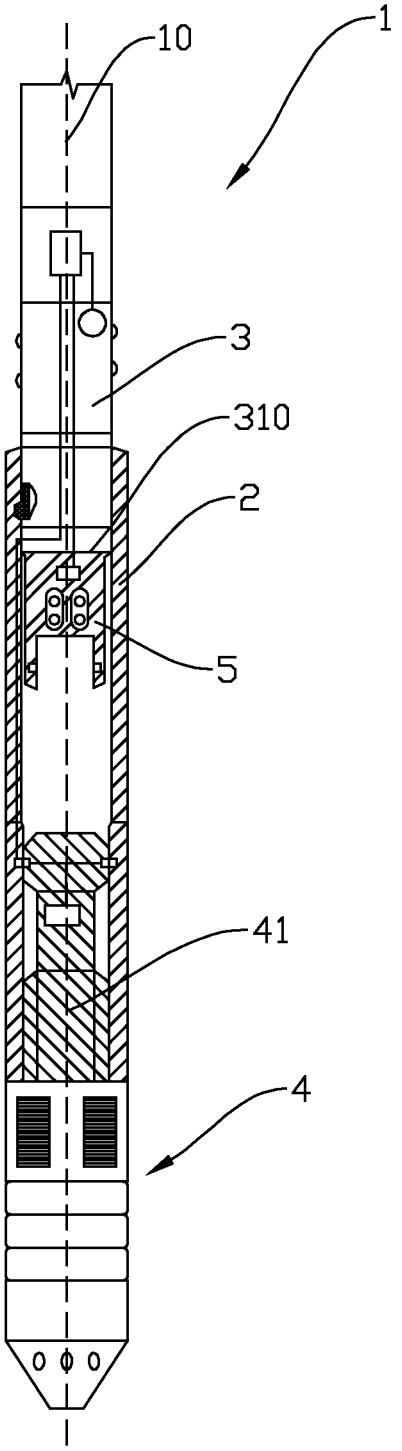
FIG. 4*a* shows a schematic elevation, partially in cross-section, of the downhole apparatus according to another embodiment of the invention.
Figure 4B:
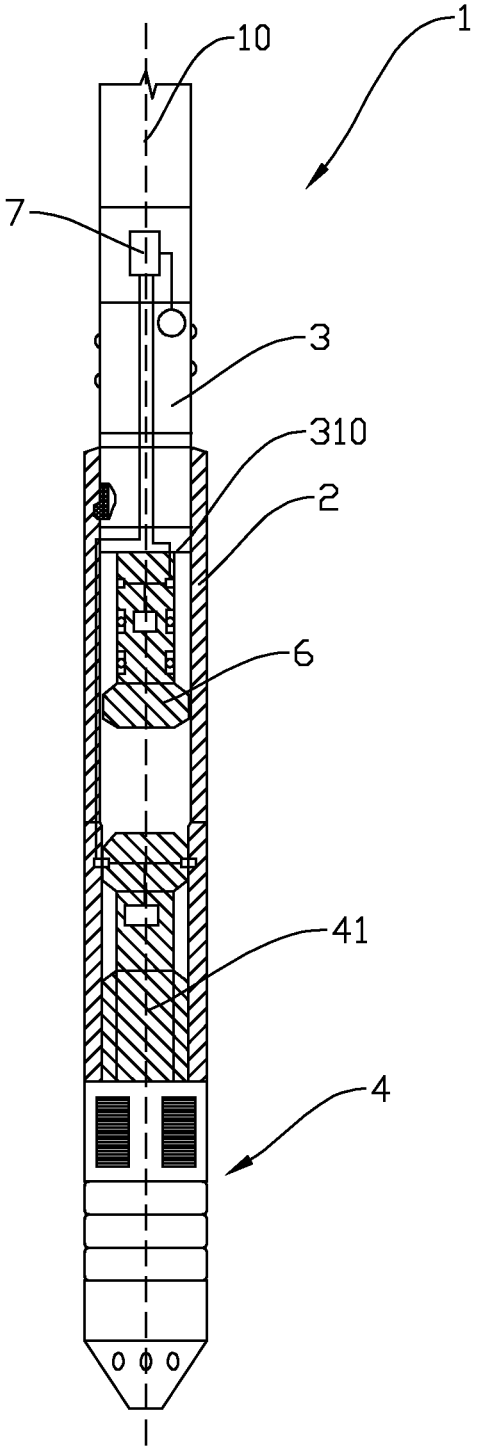
FIG. 4*b* shows a schematic elevation, partially in cross-section, of the downhole apparatus according to a third embodiment of the invention.

FIGS. 4*a* and 4*b* shows the downhole apparatus 1 according to two other embodiments of the invention respectively. FIG. 4*a* shows the puncher 5 connected to the lower portion 310 of the tool string 3. The operating principle of the plug 4, the plug setting tool 41 and the puncher 5 may be similar to what was described for the embodiments shown in FIGS. 1-3. The downhole apparatus 1 in FIG. 4*a* allows for plugging and punching of a well tubular 510 in a single run into the well 500. FIG. 4*b* shows the cutter 6 connected to the lower portion 310 of the tool string 3. The operating principle of the plug 4, the plug setting tool 41 and the cutter 6 may be similar to what was described for the embodiments shown in FIGS. 1-3. The downhole apparatus 1 in FIG. 4*b* allows for plugging and cutting of a well tubular 510 in a single run into the well 500.

It should be noted that the above-mentioned embodiment illustrates rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention claimed is:

1. A downhole apparatus, the downhole apparatus comprising:

a tool string;

a plug;

a means for setting the plug;

an upper portion of a sleeve is connectable to a lower portion of the tool string, and a lower portion of the sleeve is arranged to receive the plug and the means for setting the plug; and wherein the sleeve, between its upper portion and lower portion, is configured to house at least a tubing cutting tool, the tubing cutting tool is connected to the tool string, and the tubing cutting tool is displaceable relative to the sleeve.

2. The downhole apparatus according to claim 1, wherein the sleeve, between its upper portion and lower portion, is configured to house the tubing cutting tool and a tubing punching tool.

3. The downhole apparatus according to claim 1, wherein the sleeve is arranged to house at least a portion of the means for setting the plug.

4. The downhole apparatus according to claim 1, wherein the means for setting the plug communicates with a control device via a communications means.

5. The downhole apparatus according to claim 1, wherein the lower portion of the tool string is connected to the upper portion of the sleeve by a releasable latching mechanism.

6. The downhole apparatus according to claim 1, wherein the sleeve is configured as a junk basket when disconnected from the tool string.

7. Method for a downhole operation using a downhole apparatus comprising a tool string, a plug and a means for setting the plug, an upper portion of a sleeve being connectable to a lower portion of the tool string, and a lower portion of the sleeve being arranged to receive the plug and the means for setting the plug, the sleeve, between its upper portion and lower portion, is configured to house at least a tubing cutting tool, the tubing cutting tool is connected to the tool string and tubing cutting tool is displaceable relative to the sleeve, wherein the method comprises the steps of:

a) running the downhole apparatus into a well, and b) setting the plug in a well tubular.

8. The method for a downhole operation according to claim 7, wherein the method, after step b), further comprises the steps of:

c) releasing the sleeve from the tool string;

d) displacing the tool string relative to the sleeve, and e) cutting the well tubular above the sleeve.

9. The method for a downhole operation according to claim 7, wherein the apparatus further comprises a punching tool, the method, after step b), further comprises the steps of:

f) releasing the sleeve from the tool string;

g) displacing the tool string relative to the sleeve, and h) perforating the well tubular above the sleeve.

10. The method for a downhole operation according to claim 7, wherein the apparatus further comprises a punching tool, the method, after step b), further comprises the steps of:

i) releasing the sleeve from the tool string;

j) displacing the tool string relative to the sleeve;

k) perforating the well tubular above the sleeve, and i) cutting the well tubular above the sleeve.

* * * * *